US009808699B2

(12) United States Patent
Hockridge et al.

(10) Patent No.: US 9,808,699 B2
(45) Date of Patent: Nov. 7, 2017

(54) ADJUSTABLE SWIVEL MOUNT DEVICE FOR HEAVY PUNCHING BAG

(71) Applicant: Hoist Fitness Systems, Inc., Poway, CA (US)

(72) Inventors: Bruce Hockridge, San Diego, CA (US); Jeffrey O. Meredith, San Diego, CA (US)

(73) Assignee: HOIST FITNESS SYSTEMS, INC., Poway, CA (US)

( * ) Notice: Subject to any disclaimer, the term of this patent is extended or adjusted under 35 U.S.C. 154(b) by 372 days.

(21) Appl. No.: 14/291,926

(22) Filed: May 30, 2014

(65) Prior Publication Data

US 2015/0011366 A1 Jan. 8, 2015

Related U.S. Application Data

(60) Provisional application No. 61/842,002, filed on Jul. 2, 2013.

(51) Int. Cl.

| | |
|---|---|
| ***A63B 69/22*** | (2006.01) |
| ***A63B 69/20*** | (2006.01) |
| ***A63B 71/02*** | (2006.01) |

(52) U.S. Cl.

CPC ..... *A63B 69/205* (2013.01); *A63B 69/201* (2013.01); *A63B 71/023* (2013.01); *Y10T 29/49826* (2015.01)

(58) Field of Classification Search

CPC ... A63B 69/205; A63B 69/201; A63B 71/023; Y10T 29/49826

USPC ..... 482/83–90

See application file for complete search history.

(56) References Cited

U.S. PATENT DOCUMENTS 2,548,089 A * 4/1951 Wycosky ..... A63B 69/205 248/324
2010/0227742 A1 9/2010 Jutte
2010/0227743 A1 9/2010 Jutte

FOREIGN PATENT DOCUMENTS

GB 518988 3/1940

OTHER PUBLICATIONS

The International Search Report and Written Opinion for related PCT Application No. PCT/US2014/041672 dated Sep. 25, 2014 in 9 pages.

* cited by examiner

*Primary Examiner* — Andrew S Lo
(74) *Attorney, Agent, or Firm* — Gordon Rees Scully Mansukhani LLP; David R. Heckadon

(57) ABSTRACT

A swivel joint system for hanging a heavy punching bag from an overhead support has a swivel joint defining at least first and second perpendicular pivot axes and a hanging shaft having a lower end pivotally connected to the universal joint for rotation about the first pivot axis and an upper end configured for rotatable attachment to an overhead support for free rotation about a third pivot axis. A hanging tube is pivotally connected to the universal joint for rotation about the second pivot axis, and releasably secured to a mounting plate. A plurality of attachment members are rigidly attachable at spaced locations around the mounting plate to surround the hanging tube and configured for attachment to straps at the upper end of a heavy punching bag.

20 Claims, 8 Drawing Sheets

ADJUSTABLE SWIVEL MOUNT DEVICE FOR HEAVY PUNCHING BAG

BACKGROUND

1. Field of the Invention

This invention relates generally to punching bags and is particularly concerned with a swivel mount device for a heavy punching bag.

2. Related Art

Traditional heavy punching bag mounts either have a fixed eyebolt or a swiveling eyebolt with a combination of chains, springs and metal connecting links used to hang the heavy bag from the eyebolt. This results in metal against metal movement at several points whenever the bag is hit. Typically, straps secured to the upper ends of such bags each have metal hanging triangles which are linked to a metal link which in turn is connected to a metal link suspended below the swivel joint. The resultant metal on metal abrasion at the wear points results in failure or breaking of links after repeated use of the bag over extended periods of time.

SUMMARY

In one aspect, a swivel mount device or universal swivel mount system for hanging a heavy punching bag from an overhead support of an exercise frame or the like comprises a swivel joint defining at least first and second perpendicular pivot axes, an upper connector pivotally connected to the swivel joint for rotation about the first pivot axis and configured for attachment to an overhead support, a lower connector having an upper end pivotally connected to the swivel joint for rotation about the second pivot axis, a mounting plate secured to the lower connector below the swivel joint, and a plurality of attachment members rigidly attachable to the mounting plate and configured for engagement with straps at the upper end of a heavy punching bag.

In one embodiment, the lower connector comprises a hanging tube and the mounting plate has a central mounting hub for engagement with the hanging tube and the bag strap attachment members are secured at spaced intervals around the mounting plate.

This arrangement avoids the use of metal hanging triangles or loops on the bag straps all extending through the same metal connecting link in order to attach the bag to the swivel mount, as in the prior art, and thus avoids movement and abrasion at metal-to-metal contact areas of such links whenever the heavy bag is in motion. Instead, in one embodiment, the bag straps are attached directly to a mounting member or plate of the universal joint assembly via rigid fasteners rather than a series of metal links or the like, while the mounting plate is itself rigidly secured to the hanging tube. In one aspect of the mount system, the straps are attached to the mounting plate via respective U-bolts. This mount system eliminates metal-on-metal movable links.

In one aspect, the swivel joint device also provides for adjustment of the height of the heavy bag. In one aspect of an adjustable swivel joint, the lower hanging tube is extended in length and has a series of holes to select the hanging height, and a releasable fastener or locking pin is used to secure the mounting plate to the tube at a selected height. In one embodiment, the central mounting hub is slidably engaged over the lower hanging tube and adjusted to the desired bag height, and the releasable fastener is then engaged through aligned holes in the hub and hanging tube to select the bag height.

Other features and advantages of the present invention will become more readily apparent to those of ordinary skill in the art after reviewing the following detailed description and accompanying drawings.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for a swivel mount system or device for suspending a heavy punching bag from an overhead support. The overhead support may be secured to a wall or other support, or may be part of an upright support frame. The support frame may be a stand-alone support for the punching bag, or part of a support frame for a multi-station gym, weight cage, or other exercise apparatus.

After reading this description it will become apparent to one skilled in the art how to implement the invention in various alternative embodiments and alternative applications. However, although various embodiments of the present invention will be described herein, it is understood that these embodiments are presented by way of example only, and not limitation.

Figure 1:
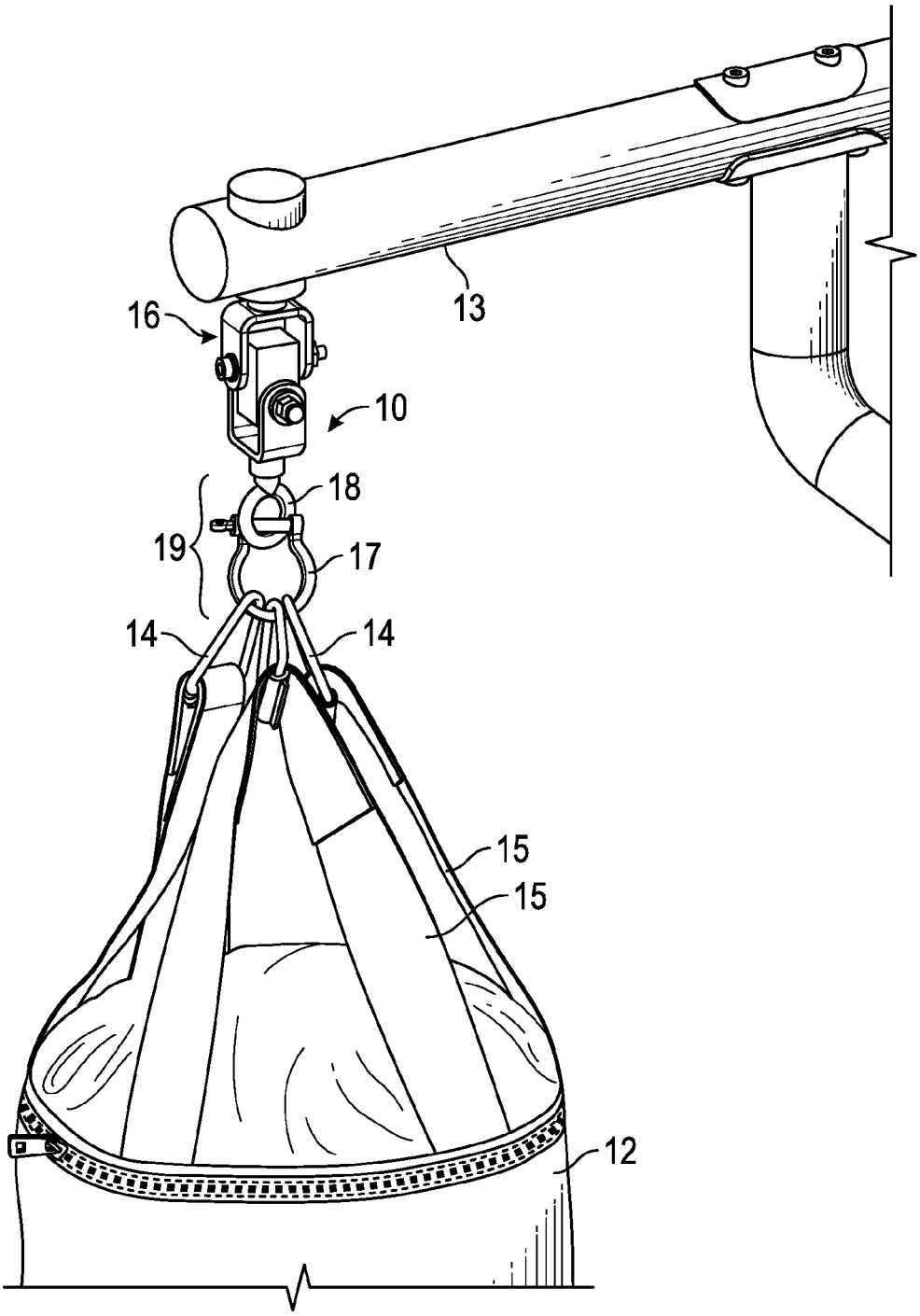
FIG. 1 (Prior Art)
FIG. 1 is a perspective view of a prior art universal swivel mount attaching the upper end of a heavy punching bag to an overhead support.

FIG. 1 illustrates a typical prior art swivel mount system 10 for suspending a heavy punching bag 12 from an overhead support 13. Metal triangles 14 connected to straps 15 at the upper end of the bag are secured to universal swivel joint 16 via metal connecting link or fastener 17, which is connected in turn to metal eyebolt 18. This results in metal on metal wear between the triangles 14 and connecting link 17, and between metal connecting link 17 and eyebolt 18, in wear areas 19 illustrated in FIG. 1. Over time, the links tend to fail due to abrasion and wearing away of metal in the wear areas.

FIGS. 2 to 5 illustrate one embodiment of a swivel mount system or assembly 20 for securing a heavy punching bag 12 to an overhead support 22 while avoiding or reducing the metal on metal wear areas of prior art arrangements. In this embodiment, interconnecting relatively movable metal loops, links, chains or the like are eliminated. In the illustrated embodiment, the overhead support or strut 22 is part of a mounting frame with connecting struts 23 and brackets 24 for attachment to support struts of a support frame such as a multi-station gym, motion cage or the like, but it will be understood that swivel mount system 20 may be used to suspend a bag 12 from any type of overhead support to which punching bags are attached. FIG. 6 illustrates one example of the swivel mount system 20 of this embodiment in use suspending heavy punching bag 12 from overhead support 22 which is secured via connecting struts 23 to frame members 27 of the support frame or cage of a gym (in this case a multi-station gym manufactured by Hoist Fitness Systems, Inc. of Poway, Calif. under the name MOTION CAGE®). However, as noted above, the swivel mount system 20 may be used with any overhead support typically used to suspend heavy punching bags, such as stand-alone punching bag stands, wall mounted supports, and the like.

Figure 2:
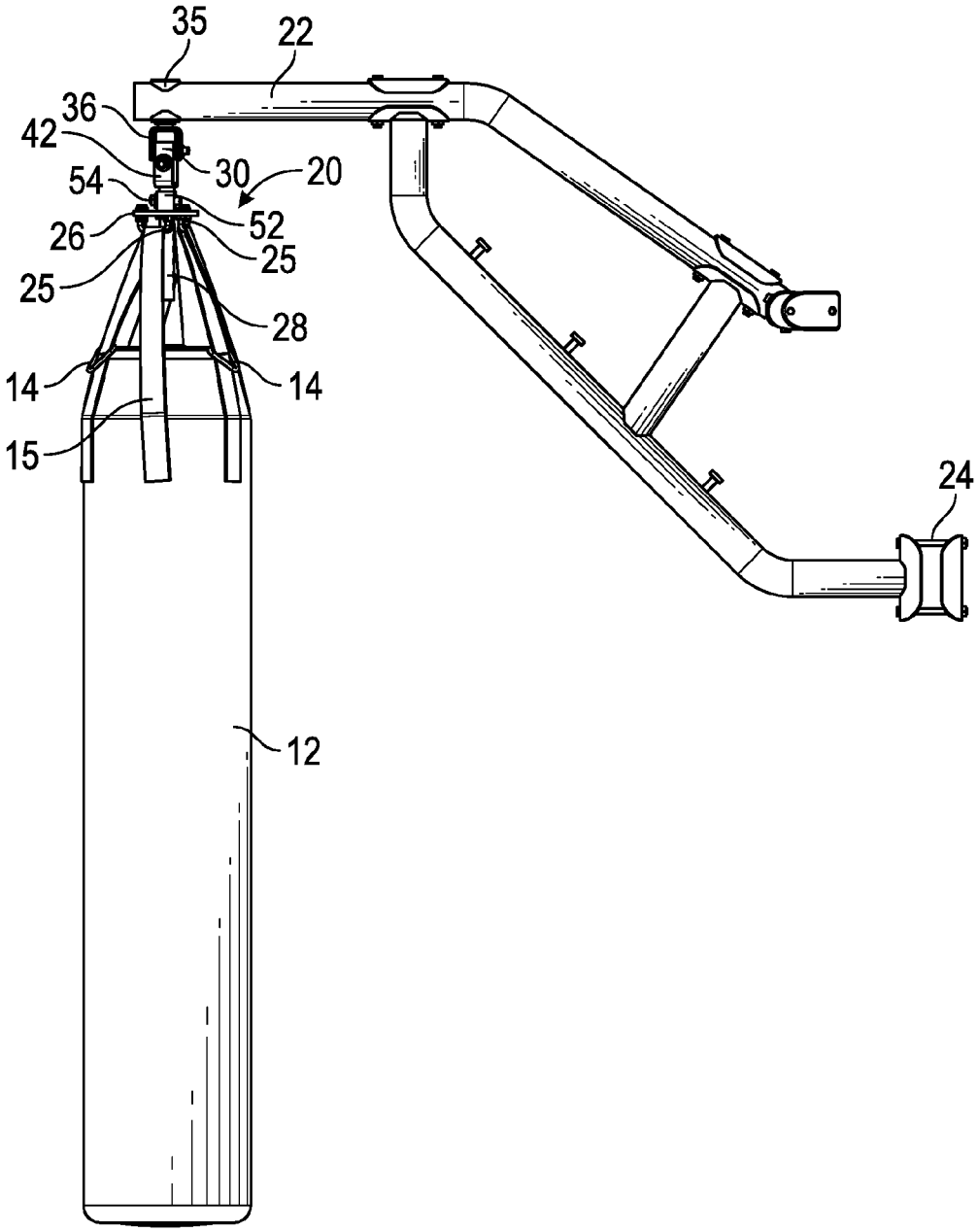
FIG. 2 is a side elevation view of one embodiment of a swivel mount device or system attaching a heavy punching bag to an overhead support.
Figure 3:
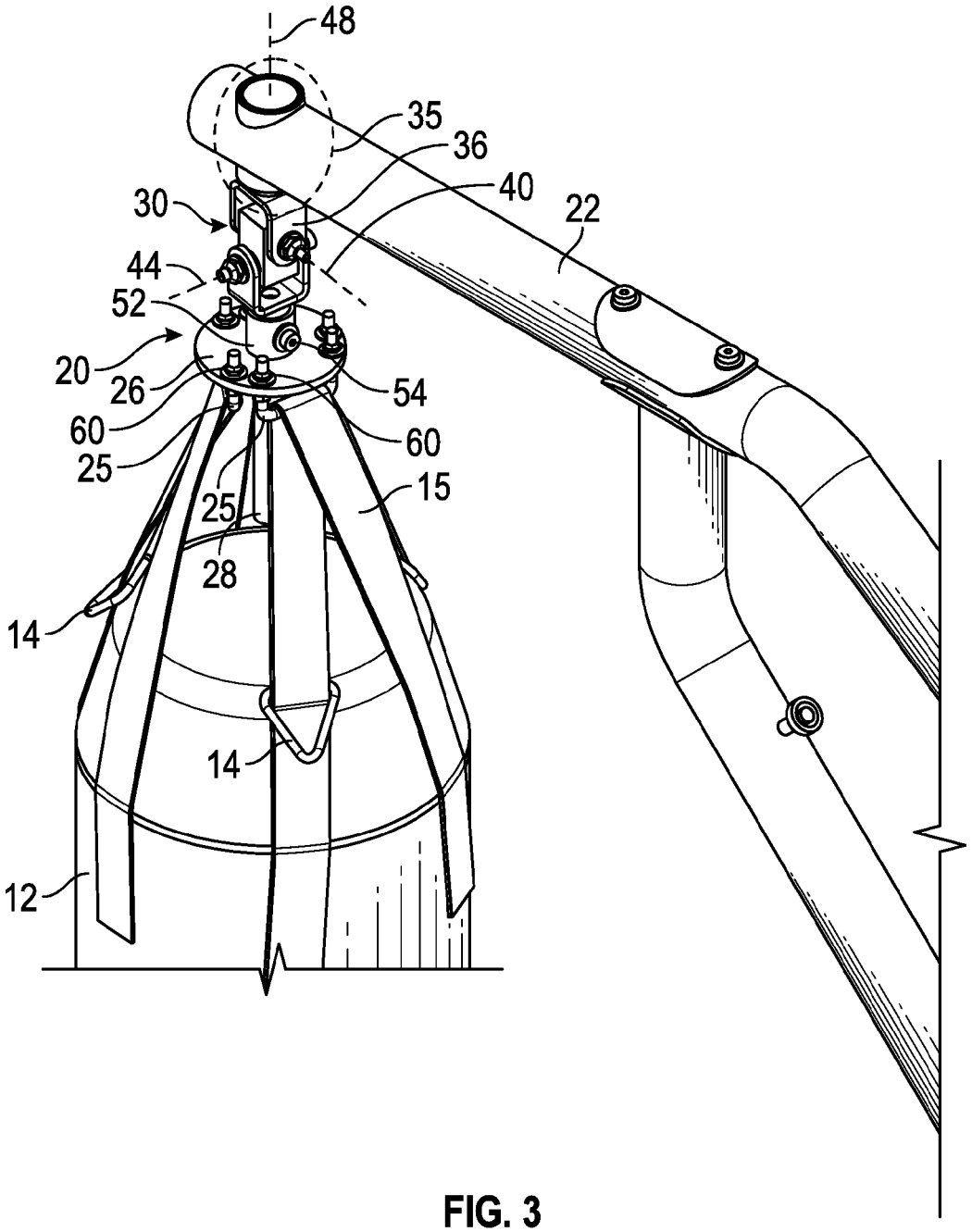
FIG. 3 is a perspective view of the swivel mount system of FIG. 2 on an enlarged scale.
Figure 4:
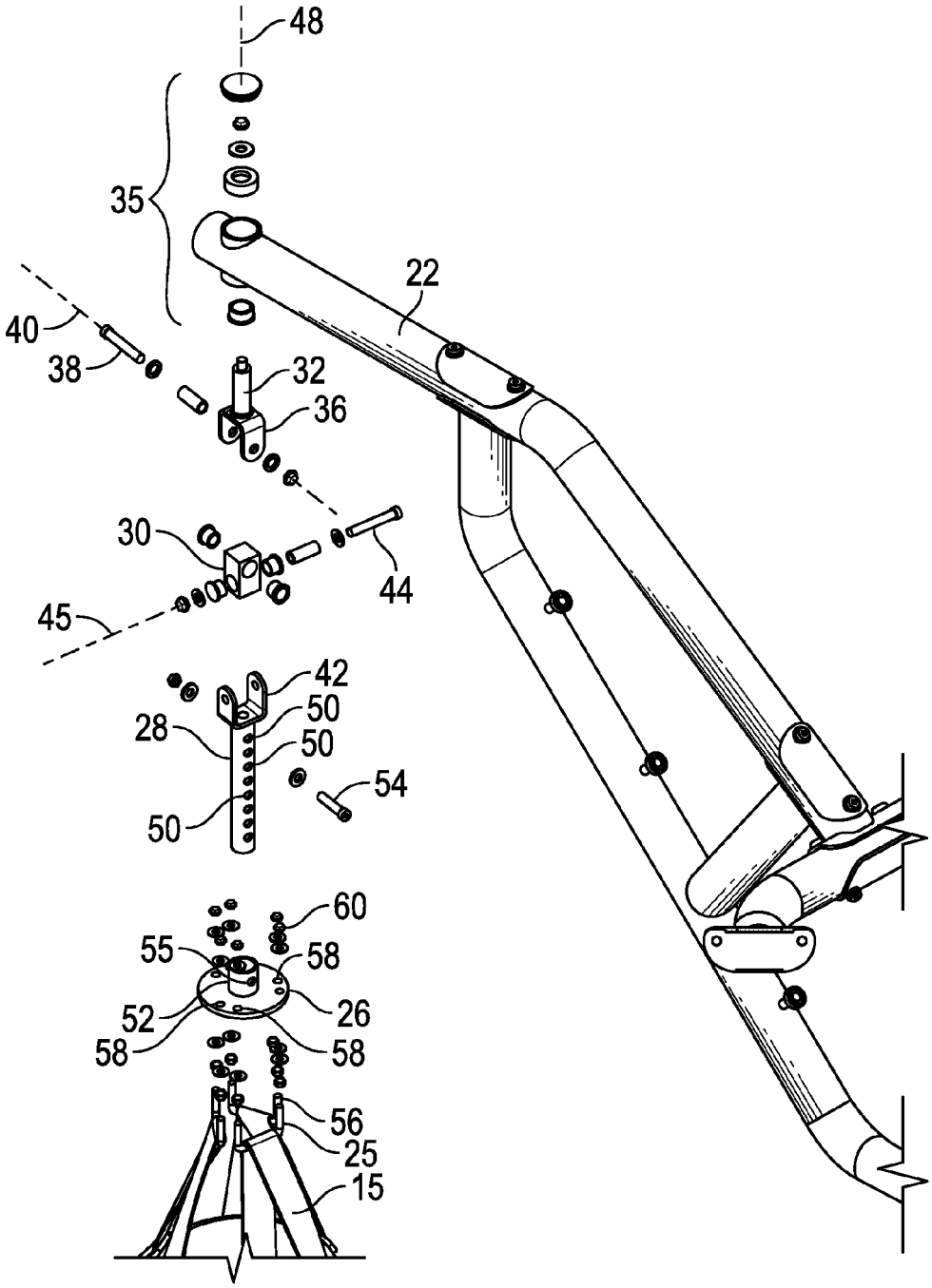
FIG. 4 is an exploded view illustrating the parts of the swivel mount system of FIG. 3.
Figure 5:
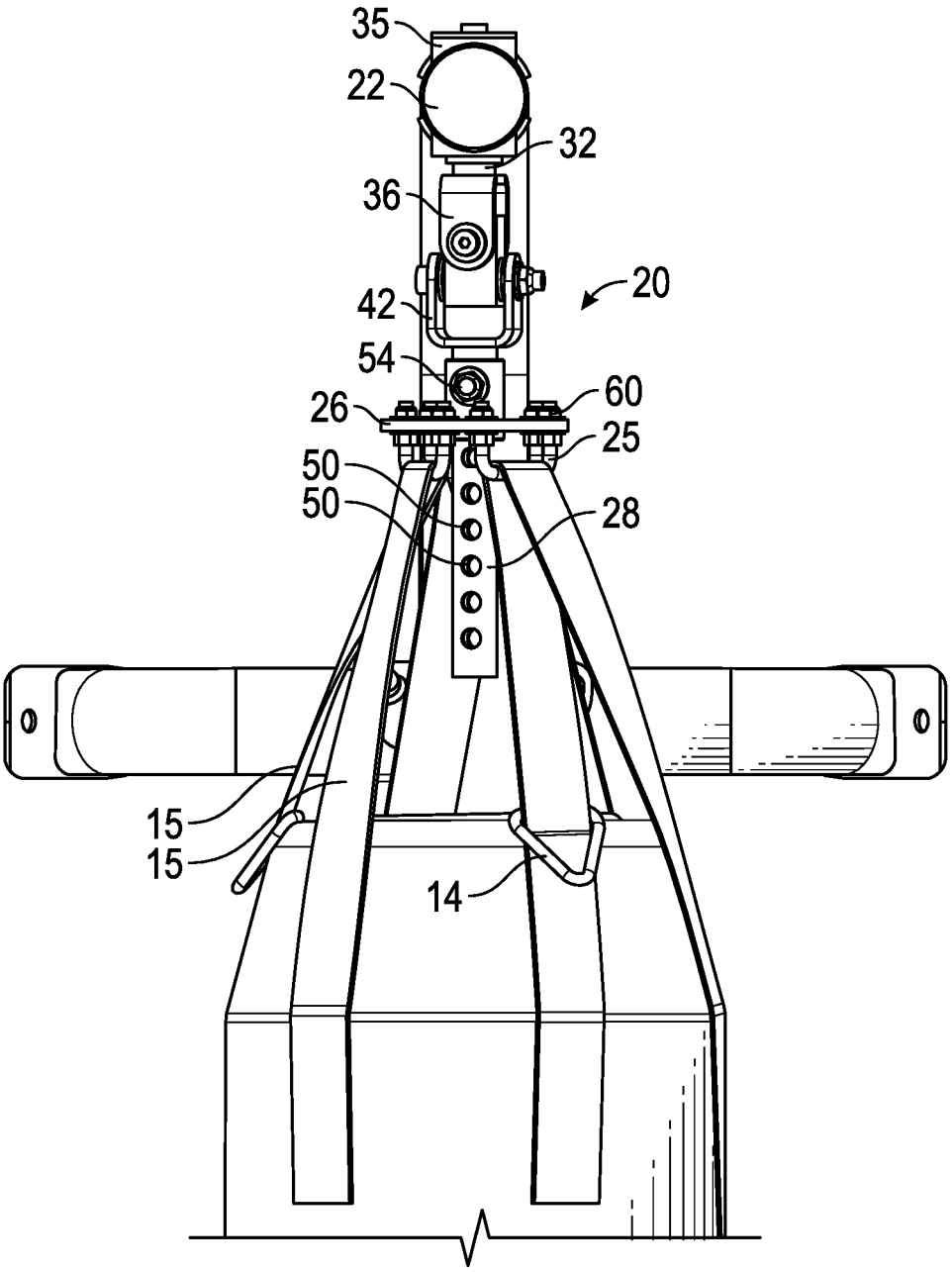
FIG. 5 is a front elevation view of the assembled swivel mount system of FIG. 2 on a larger scale.
Figure 6:
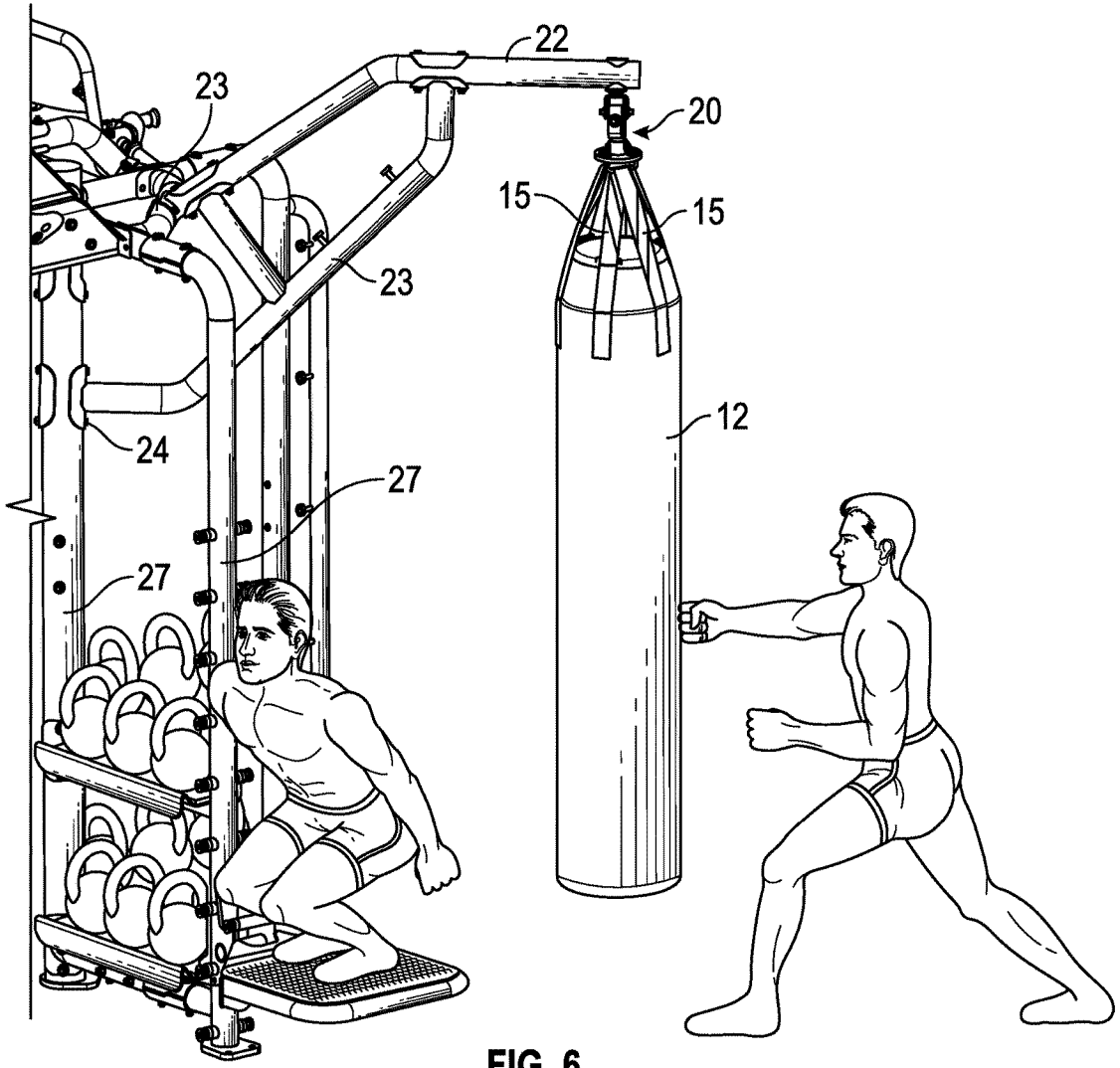
FIG. 6 illustrates one example of a heavy punching bag suspended from an overhead support on part of the frame of a multi-station gym or cage using the swivel mount system of FIGS. 2 to 5.

The separated parts of the swivel mount system 20 of this embodiment are illustrated in FIG. 4, while the assembled universal swivel mount is illustrated in FIGS. 2, 3 and 5. Swivel mount system 20 basically comprises a series of attachment members or fasteners such as U-bolts 25 designed for engagement with respective bag straps 15 as illustrated in FIGS. 4 and 5, a mounting device or plate 26, a lower connector or member 28, a universal joint member or two way swivel joint 30 which allows unrestricted movement about two perpendicular pivot axes, and an upper connector or hanging shaft 32 designed for rotatable connection in a pivot sleeve or bearing housing assembly 35 extending vertically through overhead support 22, providing unrestricted rotational movement about a third pivot axis. In the illustrated embodiment, lower connector or member 28 comprises an elongated hanging tube, but other connectors may be used in alternative embodiments, as discussed below. The mounting device 26 in the illustrated embodiment is a circular mounting plate, but other mounting devices such as non-circular plates, frames, or structures providing plural strap attachment points may be provided in alternative embodiments.

Two way swivel joint 30 is similar to the swivel joint 15 used in the prior art arrangement of FIG. 1. The main difference is the replacement of the prior metal triangles 14, connecting link 17, and eyebolt 18 with hanging tube 28, mounting plate 26, and fasteners or U-bolts 25. Hanging shaft 32 has a pivot bracket 36 at its lower end which is pivotally connected to pivot joint or swivel joint 30 via pivot pin 38 for rotation about a first pivot axis 40. Elongate hanging tube 28 has a similar pivot bracket 42 at its upper end which is pivotally connected to the pivot joint member 30 via pivot pin 44 for rotation about a second pivot axis 45 perpendicular to pivot axis 40. Pivot axes 40 and 45 define x and y pivot directions while a vertical or z pivot axis 48 is defined by the rotatable mounting of shaft 32 in the pivot sleeve or bearing housing 35 via bearings as illustrated in FIGS. 3 and 4.

A series of holes 50 are provided at spaced intervals along the length of hanging tube 28 for adjustment of the length of the swivel mount system 20 and thus the height of suspended bag 12. Mounting plate 26 has a central opening and a hub 52 aligned with the central opening for slidably receiving the hanging tube 28 which extends through the hub and mounting plate as illustrated in FIGS. 2, 3 and 5. A series of spaced pairs of fastener openings 58 are spaced around the plate 26, as illustrated in FIG. 4. A releasable locking pin or fastener 54 extends through selected holes 50 in tube 28 and aligned hole or holes 55 in diametrically opposite portions of hub 52 to secure plate 26 at a selected position on tube 28.

The fastener openings 58 in plate 26 are at predetermined spacings to receive the ends 56 of metal U-bolts 25, which are engaged with respective loops at the upper ends of bag straps 15, with opposite threaded ends 56 of each bolt extending through a respective pair of openings 58 at the periphery of plate 26 and rigidly secured in place by nuts 60. Thus, the straps 15 surround the adjustable hanging tube 28, as seen in FIGS. 2, 3 and 5 and are held separate from one another by U-bolts 25.

A method of attaching a bag to an overhead support using the swivel mount system 20 will now be described. The metal triangles or links 14 typically provided on heavy bag straps 15 to secure the bag to a metal connecting link in the prior art swivel joint system of FIG. 1 are not needed with joint system 20, and are simply dropped down out of the way, as illustrated in FIGS. 2, 3 and 5. U-bolts 25 are then engaged with the straps as in FIG. 4 and rigidly secured to mounting plate 26 with nuts 60 to attach the straps to the plate, as illustrated in FIGS. 2, 3 and 5. The mounting plate 26 is attached to the hanging tube 28 at a selected height using locking pin or bolt 54. Bag height can easily be adjusted simply by releasing the locking pin and sliding the plate up or down to the desired height, then re-inserting the locking pin through the holes 55 in hub 52 and the selected aligned hole 50 in tube 28.

As noted above, hanging tube 28 is attached to universal joint or two-way pivot joint member 30 via pivot bracket 42, while upper hanging shaft 32 is attached to the upper end of the two-way pivot joint via pivot bracket 36 at its lower end, and the upper end of the hanging shaft 32 is inserted through a thrust bearing and bushing in pivot sleeve or rotatable bearing assembly 35 (see FIG. 4) to allow unrestricted rotational movement above vertical pivot axis 48.

This arrangement eliminates both of the metal-to-metal wear areas of the prior art arrangement in FIG. 1. Both the eyebolt 18 and metal link 17 which is non-rigidly linked to eyebolt 18 and all of the metal triangles 14 in the prior art arrangement of FIG. 1 are eliminated from the swivel mount system in this embodiment, and replaced by hanging tube 28, mounting plate 26 which is rigidly connected to tube 28, and U-bolts or strap connectors 25 which in turn are rigidly connected to plate 26. Thus, there are no metal to metal wear points in the connection between the swivel joint and bag in this arrangement, i.e. areas where one metal part moves against a surface of another metal part whenever the bag is in motion. Each strap 15 is individually secured to mounting plate 26 around the hanging tube 28 secured in the center of the plate, so that movement of the straps when the bag is hit does not translated into movement of one metal connecting link against the surface of another metal connecting link or the like. Another advantage of this embodiment is that it allows height of the bag to be readily adjusted.

In alternative embodiments where height adjustment is not needed, the elongated hanging tube may be replaced with a simple shaft permanently secured to mounting plate 26. U-bolts 25 may also be replaced with other types of fasteners for securing straps 15 individually to mounting plate 26 without the metal on metal wear points of prior art arrangements.

Figure 7:
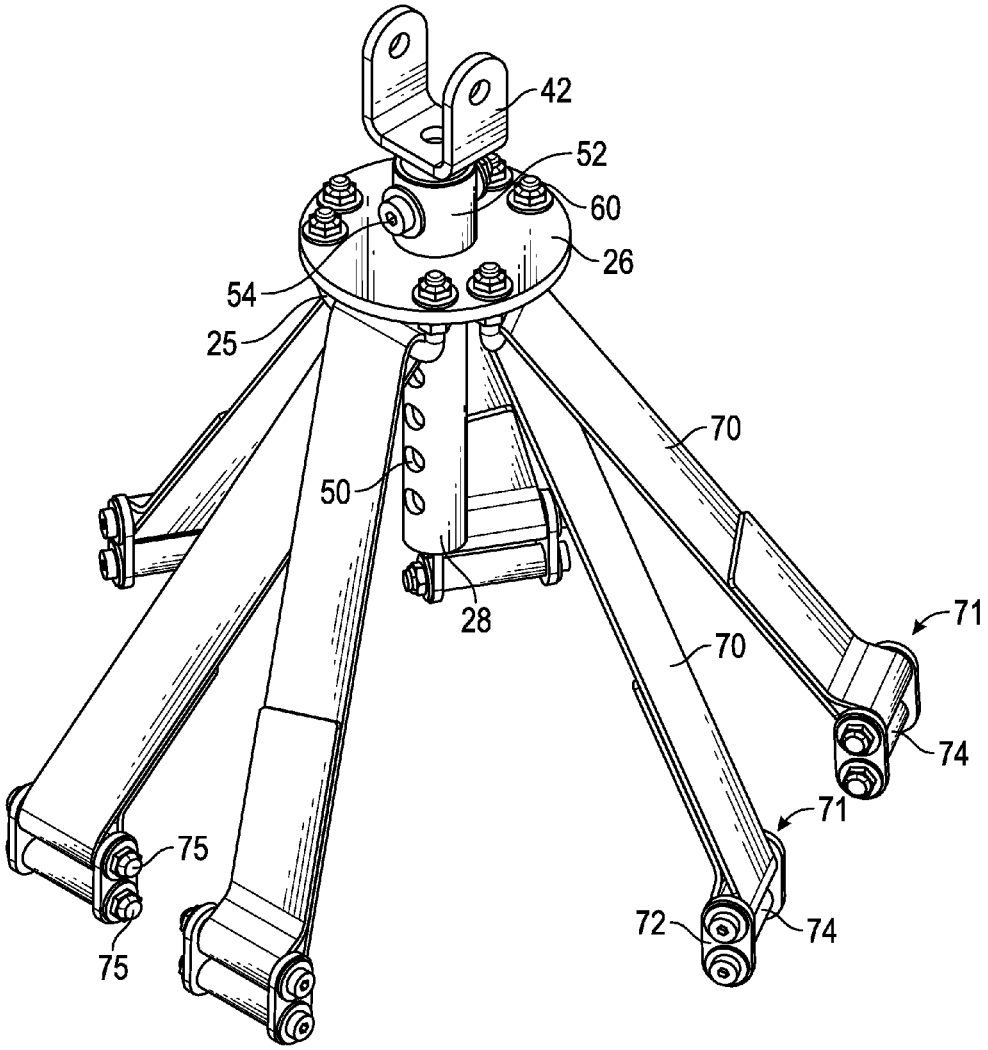
FIG. 7 is a perspective view of part of the swivel mount system of FIGS. 2 to 6 with converter strap attachments for use with heavy bags which do not have straps.
Figure 8:
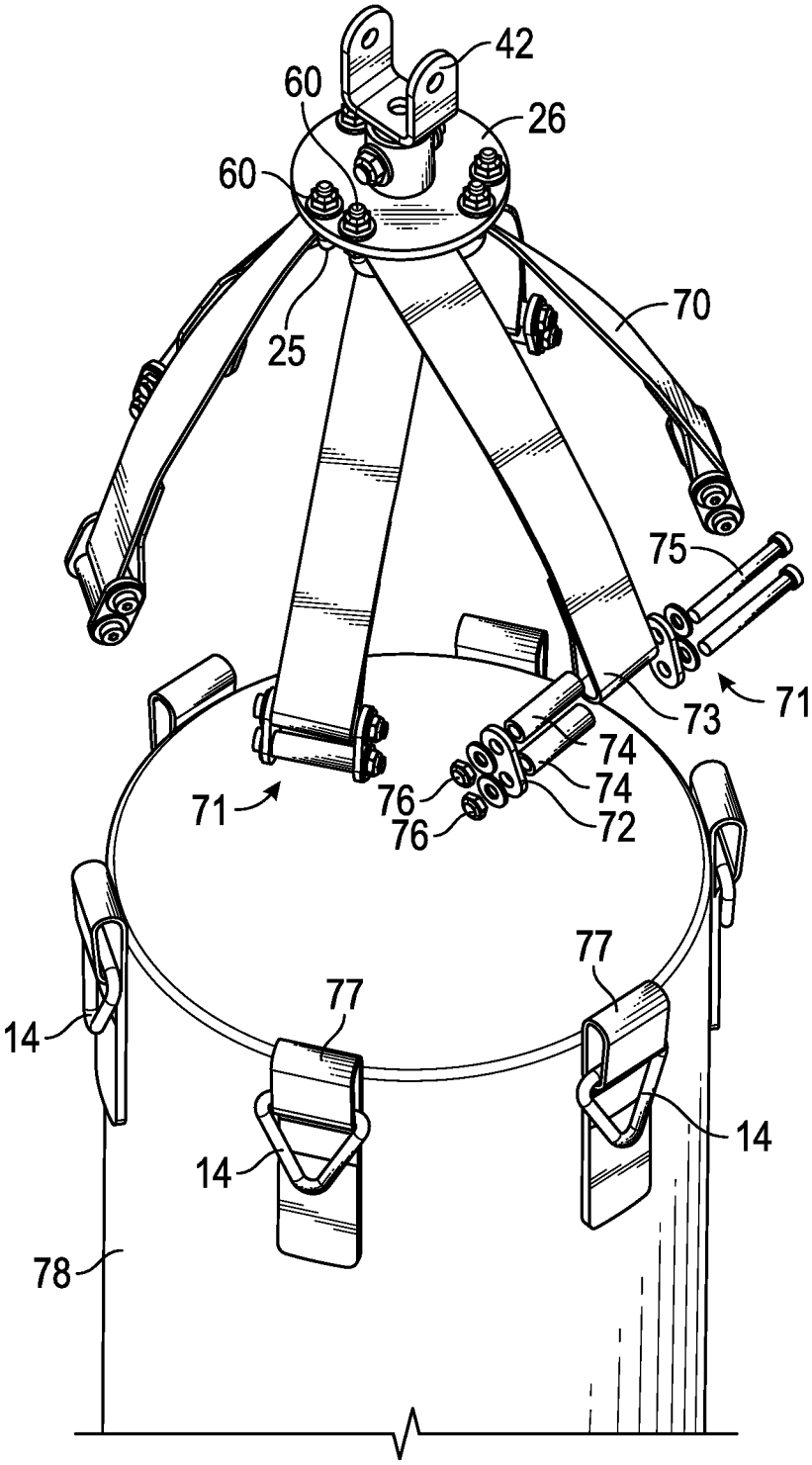
FIG. 8 is view similar to FIG. 7 but with the connecting links at opposite ends of the converter straps shown in an exploded view aligned with loops at the upper end of a heavy bag for connection to the connecting links.

FIGS. 7 and 8 illustrate an addition to the swivel mount system of FIGS. 2 to 6 to include converter straps or attachments 70 which can be secured to the swivel mount system to allow the system to be used with a heavy punching bag 78 which does not have included elongated straps 15 as in FIGS. 2, 3, 5 and 6. Instead of long straps with metal triangles as illustrated in FIG. 1, the bag 78 of FIG. 8 has spaced loops 77 around the upper end each capturing a metal triangle 14 which can be used to secure to prior art swivels as in FIG. 1 via chains or the like in a prior art arrangement. The converter straps 70 of FIGS. 7 and 8 allow such bags to be secured to the swivel mount system 20 of FIGS. 2 to 6 without using metal triangles 14.

As illustrated in FIG. 7, each converter strap 70 is engaged over a respective U-bolt 25 with opposite ends hanging down, and the U-bolt is then bolted to the mounting plate 26. The opposite ends of each strap are formed into loops 73 which are secured to connecting links or releasable fastener devices 71 for connection to respective bag loops 77, with the metal triangular links 14 dropped out of the way as in FIG. 8. Each link or fastener device 71 comprises a pair of hollow spacers or pins 74 secured between a pair of end plates or couplers 72 via bolts 75 which extend through the hollow spacers and aligned openings in end plates 72 and are secured in place by nuts 76, as best illustrated in FIG. 8. The upper spacer 74 of each link 71 extends through loop 73 at one end of a respective adapter or converter strap 70, while the lower spacer extends through an aligned loop 77 on bag 78. This allows the universal swivel mount system of FIGS. 2 to 6 to be readily converted for attachment to the type of bag shown in FIG. 8.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

We claim:

1. A swivel mount device for hanging a punching bag from an overhead support, comprising:

a swivel joint defining at least first and second perpendicular pivot axes;

an upper connector connected to the swivel joint for rotation about the first pivot axis and configured for attachment to an overhead support;

a lower member pivotally connected to the swivel joint for rotation about the second pivot axis;

a mounting device having a central connector secured to the lower member and a peripheral portion surrounding the central connector; and a plurality of attachment members rigidly attachable at spaced intervals around the peripheral portion of the mounting device and configured for engagement with respective straps secured to a punching bag, whereby each strap is secured to the mounting device independently and separately from the other punching bag straps.

2. The device of claim 1, wherein the mounting device comprises a mounting plate having a central hub secured to the lower member.

3. The device of claim 2, wherein the mounting plate is of circular shape.

4. The device of claim 2, wherein the lower member comprises an elongated hanger shaft configured for telescopic engagement with the central hub of the mounting plate and having a series of spaced attachment points for selective releasable attachment to the central hub to adjust the height of the punching bag.

5. The device of claim 1, wherein the upper connector defines a third, vertical pivot axis perpendicular to the first and second pivot axes, the upper connector being configured for rotatable attachment to an overhead support for rotation about the third pivot axis.

6. The device of claim 5, wherein the lower member comprises an elongated hanging tube having a longitudinal axis aligned with the third pivot axis, and has a series of spaced attachment points for releasably attaching the mounting device to the hanging tube for adjustment of the height of a punching bag suspended from the mounting plate.

7. The device of claim 6, further comprising a releasable lock pin for releasably securing the mounting device to the hanging tube.

8. The device of claim 7, wherein the mounting device has a central mounting hub aligned with the third pivot axis and having at least one transverse opening, the hanging tube is telescopically engaged with the central mounting hub, and the attachment points comprise a series of spaced openings for selective alignment with the locking pin to attach the mounting hub to the hanging tube, whereby the releasable lock pin is releasably engaged through the opening in the central mounting hub and a selected opening in the hanging tube to secure the punching bag at a selected height.

9. The device of claim 2, wherein each attachment member comprises a U bolt secured to the mounting plate and depending downwardly from the mounting plate.

10. The device of claim 9, wherein each strap has opposite ends secured to the punching bag and each U bolt is engaged with a looped intermediate portion of a respective strap of the punching bag.

11. The device of claim 1, wherein the straps comprise a series of extension straps each having opposite first and second ends secured to respective fasteners each configured for attachment to respective punching bag loops at the upper end of a punching bag, and an intermediate strap portion between the strap ends engaged with a respective attachment member.

12. The device of claim 11, wherein the first and second ends of the extension straps each comprise a loop.

13. An exercise apparatus, comprising:

an upright frame having an overhead support;

a punching bag having an upper end and a lower end and a plurality of straps attached around an upper portion of the punching bag;

a swivel mount device comprising a swivel joint defining at least two perpendicular pivot axes and having an upper connector depending from the overhead support, a lower member, and a mounting plate secured to the lower member; and a plurality of attachment members rigidly attached at spaced intervals around the mounting plate;

each attachment member being engaged with a respective one of the straps, whereby the punching bag is suspended from the mounting plate.

14. The apparatus of claim 13, wherein the lower member comprises an elongated hanging tube and has a series of spaced attachment points for releasably attaching the mounting plate to the hanging tube for adjustment of the height of the punching bag suspended from the mounting plate.

15. The apparatus of claim 13, further comprising a releasable lock pm for releasably securing the mounting plate to the hanging tube.

16. The apparatus of claim 14, wherein the mounting plate has a central mounting hub coaxial with the upper connector and having at least one transverse opening, the hanging tube is telescopically engaged with the central mounting hub, and the attachment points comprise a series of spaced openings for selective alignment with the transverse opening to attach the mounting hub to the hanging tube, whereby the releasable lock pin is releasably engaged through the opening in the central mounting hub and a selected opening in the hanging tube to secure the punching bag at a selected height.

17. The apparatus of claim 13, wherein the mounting plate has an upper surface and a lower surface, and each attachment member comprises a U-bolt secured to the lower surface of the mounting plate, each strap having at least one loop engaging through a respective U-bolt.

18. The apparatus of claim 17, wherein each strap has opposite ends secured to the punching bag to form an extended loop.

19. The apparatus of claim 17, further comprising a plurality of second loops secured around the upper end portion of the punching bag, each strap comprising an extension strap extending through the U-bolt and having opposite ends secured to respective adjacent second loops.

20. The apparatus of claim 13, wherein the upper connector is rotatably secured to the overhead support to define a third axis of rotation perpendicular to the first and second axes of rotation.

* * * * *